US005473913A

United States Patent [19]

Bogucki-Land

[11] Patent Number: 5,473,913

[45] Date of Patent: Dec. 12, 1995

[54] WARP KNITTING MACHINE HAVING ELECTRICALLY ACTIVATED DRIVE ARRANGEMENT

[75] Inventor: Bogdan Bogucki-Land, Offenbach, Germany

[73] Assignee: Karl Mayer Textilmaschinenfabrik GmbH, Obertshausen, Germany

[21] Appl. No.: 412,167

[22] Filed: Mar. 28, 1995

[30] Foreign Application Priority Data

Apr. 2, 1994 [DE] Germany ..... 44 11 628.8

[51] Int. Cl.[6] ..... D04B 27/26

[52] U.S. Cl. ..... 66/207; 66/204; 310/46

[58] Field of Search ..... 66/204, 207, 219; 310/328, 46; 250/561; 305/302

[56] References Cited

U.S. PATENT DOCUMENTS

| | | | |
|---|---|---|---|
| 4,099,390 | 7/1978 | Vinas | 66/219 |
| 4,110,012 | 8/1978 | Jarvis | 350/302 |
| 4,458,508 | 7/1984 | Englert et al. | 66/207 |
| 4,611,475 | 9/1986 | Bergmann . | |
| 4,614,095 | 9/1986 | Porat | 66/207 |
| 4,761,973 | 8/1988 | Gangi | 66/204 |
| 5,291,024 | 3/1994 | Barea | 250/561 |
| 5,307,648 | 5/1994 | Forkert et al. | 66/207 |
| 5,311,751 | 5/1994 | Winter et al. | 66/207 |
| 5,311,752 | 5/1994 | Gille . | |
| 5,378,948 | 1/1995 | Richter | 310/328 |

FOREIGN PATENT DOCUMENTS

| | | | |
|---|---|---|---|
| 2124519 | 5/1971 | Germany . | |
| 3442090 | 11/1984 | Germany . | |
| 3734072 | 10/1987 | Germany . | |
| 4008155 | 3/1990 | Germany . | |
| 4215691 | 5/1992 | Germany . | |
| 2049824 | 12/1980 | United Kingdom | 66/207 |

*Primary Examiner*—John J. Calvert

*Attorney, Agent, or Firm*—Omri M. Behr; Matthew J. McDonald

[57] ABSTRACT

A warp knitting machine having a main shaft has at least one bar mounted to reciprocate in accordance with a predetermined schedule. The machine also has an electrically activated drive arrangement with a body made of a material that can alter at least one of its dimensions in dependence upon the magnitude of an applied field. The machine also has a control arrangement coupled to the drive arrangement for providing an electrical signal thereto, in accordance with the predetermined schedule and in dependence upon the angular displacement of the main shaft. This electrical signal can establish the applied field with a predetermined timing within each displacement step of the one bar.

19 Claims, 1 Drawing Sheet

WARP KNITTING MACHINE HAVING ELECTRICALLY ACTIVATED DRIVE ARRANGEMENT

FIELD OF THE INVENTION

The present invention is directed to a warp knitting machine having at least one bar which is axially displaceable by means of an electrically activatable drive arrangement and an appropriate control arrangement, in accordance with a predetermined schedule depending upon the rotational angle of the main shaft.

DISCUSSION OF RELATED ART

Warp knitting machines of this general type are known. For the drive arrangement, they comprise a setting motor, in particular, a linear motor. In accordance with DE OS 37 34 072 (U.S. Pat. No. 4,989,423) such a setting motor is a stepping motor to which stepping pulses are provided by a control arrangement. The number of available steps are prescribed in dependence upon the rotational angle setting of the main shaft, by a program.

In such a situation during the start-up of a warp knitting machine, the initial position of the individual bars must be tested and accordingly corrected, since after a power failure (for example), it is possible that displacement errors have occurred.

In accordance with DE OS 42 15 691(U.S. Pat. No. 5,311,752) the setting motor is controlled in dependence upon the deviation from a norm by a position control circuit which compares the position ("actual measured value") with the position ("target value") provided by the program. This gives rise to structural complexity.

An object of the present invention is to provide a warp knitting machine of the prior art type with a far simpler control means for the drive arrangement, in particular, one wherein faults are avoided during the start-up of the machine.

SUMMARY OF THE INVENTION

In accordance with the illustrative embodiments demonstrating features and advantages of the present invention, there is provided a warp knitting machine with a main shaft and having at least one bar mounted to reciprocate in accordance with a predetermined schedule. The machine includes an electrically activated drive arrangement having a body made of a material which alters at least one of its dimensions in dependence upon the magnitude of an applied field. The machine also has a control arrangement coupled to the drive arrangement for providing thereto, in accordance with the predetermined schedule and in dependence upon the angular displacement of the main shaft, an electrical signal for establishing the applied field with a predetermined timing within each displacement step of the one bar.

By employing apparatus of the foregoing type an improved warp knitting machine is achieved. The preferred machine employs a drive arrangement with a body of a material which alters its dimensions in accordance with the size of an electrical and/or magnetic field and wherein a program controlled control arrangement generates an electrical signal for the provision of this field, which has a predetermined run time during each displacement step.

In one particular embodiment, the drive arrangement has a piezoelectric activating element and the electrical signal is electric potential. It is even more advantageous if the drive arrangement has a magnetostrictive activation element and the electrical signal is the current.

In a preferred embodiment, the drive arrangement comprises a plurality of sequential activating elements, which are excitable either individually or in combination, by the control arrangement. In this manner, there is obtained a summation drive in which the total displacement path is determined by the sum of the size changes of all of the excited activation elements.

It is particularly advantageous if the electrical signal has a predetermined time run within a displacement step which, leads to a progressive change in the initial acceleration of the bar and to a progressive change in the concluding deceleration of the bar. The counter forces called forth by the mass moment of inertia of the bar are held to low values so that there is obtained a very accurate and rapid result.

BRIEF DESCRIPTION OF THE DRAWINGS

The invention may be further explained by means of the following drawings illustrating the preferred embodiments.

DETAILED DESCRIPTION OF THE DRAWINGS

Figure 1:
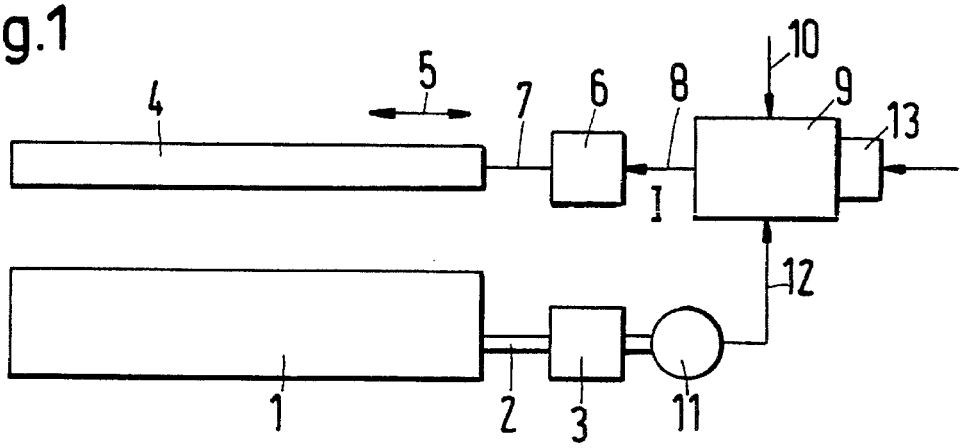
FIG. 1 is a schematic representation of a warp knitting machine in accordance with the present invention.

FIG. 1 shows a warp knitting machine 1, whose main shaft 2 is driven by motor 3 which, in the conventional way, displaces the needle and slider bars as well as, permitting the guide bars to swing through, of which one bar 4, is shown. In order to displace bar 4 in the longitudinal direction (arrow 5), there is provided a drive arrangement 6 which is connected to bar 4 via rod suitably, via a ball link at both ends.

Included in the term "bar" are not only guide bars, but all other types of axially displaceable bar for example, pile sinker bars.

The drive arrangement 6 is a magnetostrictive activating element (actor) comprising a body of ferromagnetic material whose mechanical dimensions are altered under the influence of a magnetic field. Such materials include, for example, iron, nickel or cobalt. It is especially preferred that the body comprise a highly magnetostrictive alloy comprised of terbium, iron and dysprosium.

The field is generated with the assistance of a current I which is led via output 8 of a control arrangement 9. The magnitude of the current I is determined by a program which can be provided over input means 10 and whose time run is dependent upon the rotational angle position of the main shaft 2. The programming can be established by conventional cams or by a computer that receives angular data about the main shaft 2.

For this purpose there is provided an angle measuring arrangement 11, whose output 12 influences the control arrangement 9. By means of a correction arrangement 13, there may be provided a multiplication factor whereby, the current I provided by the program may be multiplied in order to take into account heat expansion, or the like.

Figure 2:
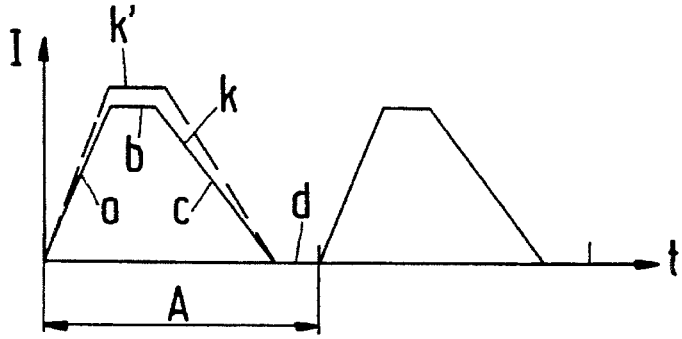
FIG. 2 is a current time diagram for a particular program sequence.

An example of the time run of the current I is shown as curve K in FIG. 2. Underneath the saturation region, the length change of the magnetostrictive body in drive arrangement 6 is substantially proportional thereto. For example, within the work cycle A, a segment "a" of curve K is carried through in the overlap displacement. In segment "b" there follows the swing-through in the underlap position. In segment "c" there follows the underlap displacement. In segment "d" the needles swing back into the overlap position.

The curve K' of FIG. 2 shown in phantom illustrates how the current and with it the displacement would run when a multiplication factor is inserted into the correction arrangement 13. It is advantageous when the control arrangement comprises a correcting arrange-so that the electrical signal can be altered by a predetermined factor. In this connection it is sufficient if the individual displacement of the correction arrangement considers the length changes which of necessity arise because of heat expansion, in particular of the needle bar.

Figure 3:
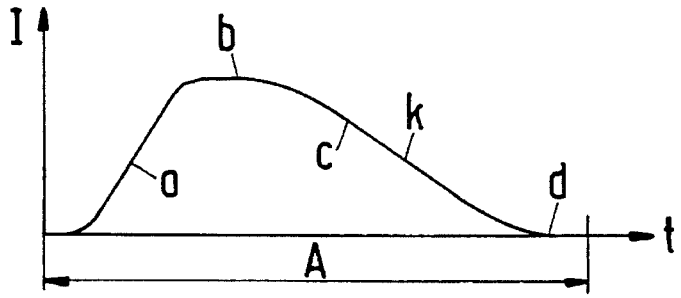
FIG. 3 is a slightly altered current time diagram.

It will be noted that at every program time point the control arrangement 9 gives each bar 4 a particular current so that, even at the beginning, a well defined position of the bar is available. In FIG. 3 there is shown, in somewhat expanded form, that in curve K the individual segments "a", "b", "c" and "d" do not run in a linear fashion, but rather that there are progressive transitions between them. In this manner, at the beginning there is a progressive change in the acceleration of bar 4 and at the end a progressive deceleration of bar 4. Thus, no excessive counter forces operate on the magnetostrictive activating element so that a more efficient procedure results.

It is advantageous if the bar 4 is rigidly or positively attached to the output member of the drive arrangement 6 and is not biased by a return spring. The return spring should be omitted, since by its action it may influence the electrical signal in the activating element. By means of a rigid or positive connection, (for example by means of a ball joint) the activating element at the same time acts as a return element.

Figure 4:
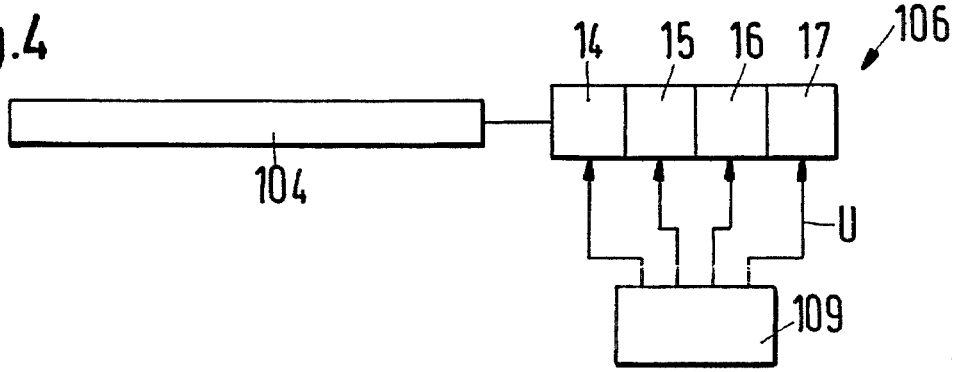
FIG. 4 is a schematic representation of an alternate drive arrangement.

FIG. 4 illustrates an embodiment in which the guide bar 104 is activated by a drive arrangement 106 comprising four sequentially arranged piezoelectric activating elements (actors) 14 through 17 which, together, but in selective combinations selected by the control arrangement 109, may be provided with electrical potential. The displacement of bar 103 corresponds to the sum of the length alterations of the appropriately excited activating elements. In the simplest case, all of the activating elements are similarly formed and are controlled by the same potential. Such piezoelectric activating elements are known and are commercialized by the company "Physir Instruments" under the trade name of "Piezo Translators".

Where a piezoelectric activating element is utilized for the increase of the displacement, the potential must be raised so insulation problems should be considered. In magnetostrictive activating elements, the current must be raised, which generally speaking does not give rise to difficulties.

In operation, with the drive arrangement 6 utilized herein, the electrical signal has a direct connection to the appropriate dimension. A program predetermined change in the electrical signal gives rise to a defined change in the size, that is, to a defined displacement. This gives rise to very simple control. When, at the start of the process, a particular electrical signal associated with a particular program time point is called up, the bar 4 automatically takes up its correct initial position.

A further advantage is found therein that the alteration of the size can occur very rapidly and with considerable force, which enables it to readily overcome the mass moment of inertia of the bar 4, which therefore plays practically no role with respect to the drive arrangement 6. There is thus given a particularly quiet running of the warp knitting machine 1, since not only does the program guidance enable new displacement sizes to occur in each work cycle, but also within each cycle it is possible to provide a continuous timely control over the displacement step.

I claim:

1. Warp knitting machine having at least one bar mounted to reciprocate through displacement steps in accordance with a predetermined schedule, a main shaft, and means comprising:

an electrically activated drive arrangement having a body made of a material which alters at least one dimension in dependence upon an applied field magnitude; and a control arrangement coupled to said drive arrangement for providing thereto, in accordance with said predetermined schedule and in dependence upon angular displacement of the main shaft, an electrical signal for establishing said applied field with a predetermined timing within each displacement step of said one bar.

2. Warp knitting machine according to claim 1 wherein said applied field is an electrical potential field.

3. Warp knitting machine in accordance with claim 2 wherein said drive arrangement comprises a piezoelectrically actuatable element and wherein the electrical signal provides a potential across at least a portion of said material.

4. Warp knitting machine according to claim 1 wherein said applied field is a magnetic field.

5. Warp knitting machine in accordance with claim 4 wherein the drive arrangement comprises a magnetostrictively actuatable element and wherein the electrical signal provides a magnetizing current.

6. Warp knitting machine in accordance with claim 5, wherein the bar is positively connected with the body of said drive arrangement, said bar being unbiased by a spring force.

7. Warp knitting machine in accordance with claim 3, wherein the bar is positively connected with the body of said drive arrangement, said bar being unbiased by a spring force.

8. Warp knitting machine in accordance with claim 1, wherein the bar is positively connected with the body of said drive arrangement, said bar being unbiased by a spring force.

9. Warp knitting machine in accordance with claim 5 wherein said drive arrangement comprises:

a plurality of sequentially arranged activating elements, which are selectively actuatable either singly or in combination by the control arrangement.

10. Warp knitting machine in accordance with claim 3, wherein said drive arrangement comprises:

a plurality of sequentially arranged activating elements, which are selectively actuatable either singly or in combination by the control arrangement.

11. Warp knitting machine in accordance with claim 1, wherein said drive arrangement comprises:

a plurality of sequentially arranged activating elements, which are selectively actuatable either singly or in combination by the control arrangement.

12. Warp knitting machine in accordance with claim 1 wherein the electrical signal during a displacement step is timed to produce a gradual change in (a) the initial acceleration of said bar, and (b) the concluding deceleration of said bar.

13. Warp knitting machine in accordance with claim 3, wherein the electrical signal during a displacement step is timed to produce a gradual change in (a) the initial acceleration of said bar, and (b) the concluding deceleration of said bar.

14. Warp knitting machine in accordance with claim 5, wherein the electrical signal during a displacement step is timed to produce a gradual change in (a) the initial acceleration of said bar, and (b) the concluding deceleration of said bar.

15. Warp knitting machine in accordance with claim 11, wherein the electrical signal during a displacement step is timed to produce a gradual change in (a) the initial acceleration of said bar, and (b) the concluding deceleration of said bar.

16. Warp knitting machine in accordance with claim 1, wherein said control arrangement comprises:

a correcting arrangement for altering said electrical signal by a preset factor in dependence upon an input signal.

17. Warp knitting machine in accordance with claim 3, wherein said control arrangement comprises:

a correcting arrangement for altering said electrical signal by a preset factor in dependence upon an input signal.

18. Warp knitting machine in accordance with claim 5, wherein said control arrangement comprises:

a correcting arrangement for altering said electrical signal by a preset factor in dependence upon an input signal.

19. Warp knitting machine in accordance with claim 11, wherein said control arrangement comprises:

a correcting arrangement for altering said electrical signal by a preset factor in dependence upon an input signal.

* * * * *